US005964401A

United States Patent [19]

Thill

[11] Patent Number: 5,964,401

[45] Date of Patent: Oct. 12, 1999

[54] MAIL BOX INDICATOR SYSTEM

[76] Inventor: Gene R. Thill, 1002 E. 65th St. North, Sioux Falls, S. Dak. 57104

[21] Appl. No.: 09/195,958

[22] Filed: Nov. 19, 1998

[51] Int. Cl.[6] ..... B65D 91/00

[52] U.S. Cl. ..... 232/35; 232/17; 116/173

[58] Field of Search ..... 232/17, 34, 35; 43/15, 16, 17; 116/173, 174

[56] References Cited

U.S. PATENT DOCUMENTS

| | | | |
|---|---|---|---|
| D. 249,782 | 10/1978 | Marcus . | |
| D. 355,473 | 2/1995 | Booth . | |
| 2,433,940 | 1/1948 | Weaver | 232/35 |
| 3,482,543 | 12/1969 | Guidos | 232/35 |
| 3,646,698 | 3/1972 | Zachae . | |
| 3,727,342 | 4/1973 | Lindsey, Jr. . | |
| 3,962,812 | 6/1976 | Means et al. . | |
| 4,146,988 | 4/1979 | Bednarczyk . | |
| 4,552,302 | 11/1985 | Rung | 232/35 |
| 4,571,876 | 2/1986 | LeClair . | |
| 4,573,281 | 3/1986 | Moisan . | |
| 4,574,726 | 3/1986 | Sullivan | 116/174 X |
| 4,728,028 | 3/1988 | Barnes et al. | 232/35 |
| 5,076,337 | 12/1991 | Reuter | 232/35 |
| 5,082,170 | 1/1992 | Goss | 232/35 |
| 5,123,590 | 6/1992 | Teele | 232/35 |
| 5,152,093 | 10/1992 | Bartys . | |
| 5,485,700 | 1/1996 | Van Vranken | 116/173 X |
| 5,638,629 | 6/1997 | Robichaud et al. . | |

FOREIGN PATENT DOCUMENTS

| | | |
|---|---|---|
| WO 94/15458 | 7/1974 | WIPO . |
| WO 97/40666 | 11/1997 | WIPO . |

*Primary Examiner*—Terry Lee Melius
*Assistant Examiner*—William L. Miller

[57] ABSTRACT

A mail box indicator system includes a flag post having a flag attached to the post by a removable collar. The post is further attached to an elbow member by a coil. The elbow member is attachable to wall of a mail box. The coil urges the post into a substantially vertical position. A retention assembly is provided for holding the post in a substantially horizontal orientation when in a set position. The retention assembly is attached to the door of the mail box such that the post disengages the retention assembly when the mail box door is opened. In an alternate embodiment, the mail box indicating system includes a spacer to selectively position the post retention assembly in spaced relationship to the mail box door such that a mail box protrusion proximate the mail box door does not interfere with engagement of the post to the post retention assembly. The elbow member is attachable to the mail box using a bolt and nut holding a pair of rubber washers around a wall of the mail box. Preferably, a pair of metal washers are positioned around the rubber washers.

13 Claims, 2 Drawing Sheets

MAIL BOX INDICATOR SYSTEM

BACKGROUND OF THE INVENTION

1. Field of the Invention

The present invention relates to mail box indicators and more particularly pertains to a new mail box indicator system for indicating the presence of new mail in a mail box.

2. Description of the Prior Art

The use of mail box indicators is known in the prior art. More specifically, mail box indicators heretofore devised and utilized are known to consist basically of familiar, expected and obvious structural configurations, notwithstanding the myriad of designs encompassed by the crowded prior art which have been developed for the fulfillment of countless objectives and requirements.

The inventive device includes a spring biased flag pole and a retention assembly attachable to a mail box for holding the flag in a set position prior to the opening of the mail box for the insertion of new mail.

In these respects, the mail box indicator system according to the present invention substantially departs from the conventional concepts and designs of the prior art, and in so doing provides an apparatus primarily developed for indicating the arrival of new mail without having to approach and open the mail box.

SUMMARY OF THE INVENTION

In view of the disadvantages inherent in the known types of mail box indicators now present in the prior art, the present invention provides a new mail box indicator system construction wherein the same can be utilized for indicating the presence of mail within a mail box without having to approach and open the mail box.

The general purpose of the present invention, which will be described subsequently in greater detail, is to provide a new mail box indicator system and method which has many of the advantages of the mail box indicators commonly known and many novel features that result in a new mail box indicator system which is not anticipated, rendered obvious, suggested, or even implied by any of the prior art mail box indicators, either alone or in any combination thereof.

To attain this, the present invention generally comprises a spring biased flag pole and retention assembly attachable to a mail box for holding the flag pole in a set position prior to the opening of the mail box for the insertion of new mail.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new mail box indicator system and method which has many of the advantages of the mail box indicators commonly known and many novel features that result in a new mail box indicator system which is not anticipated, rendered obvious, suggested, or even implied by any of the prior art mail box indicators, either alone or in any combination thereof.

It is another object of the present invention to provide a new mail box indicator system that may be easily and efficiently manufactured and marketed.

It is a further object of the present invention to provide a new mail box indicator system that is of a durable and reliable construction.

An even further object of the present invention is to provide a new mail box indicator system that is susceptible of a low cost of manufacture with regard to both materials and labor, and that accordingly is then susceptible of low prices of sale to the consuming public, thereby making such a mail box indicator system economically available to the buying public.

Still yet another object of the present invention is to provide a new mail box indicator system that provides in the apparatuses and methods of the prior art some of the advantages thereof, while simultaneously overcoming some of the disadvantages normally associated therewith.

Still another object of the present invention is to provide a new mail box indicator system for indicating the presence of new mail within a mail box without having to approach and open the mail box.

Yet another object of the present invention is to provide a new mail box indicator system which includes a spring biased flag pole and retention assembly attachable to a mail box for indicating the presence of new mail within the mail box.

Still yet another object of the present invention is to provide a new mail box indicator system that gives a visual alert when the mail box is opened for the insertion of new mail.

Even still another object of the present invention is to provide a new mail box indicator system that is adaptable for use with mail boxes of varying shapes and sizes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
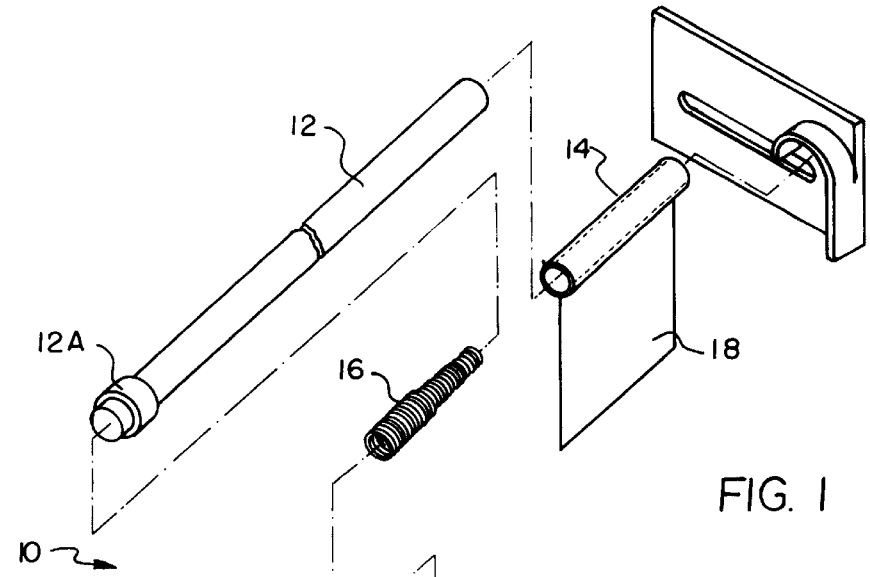
FIG. 1 is an exploded view of a new mail box indicator system according to the present invention.
Figure 2:
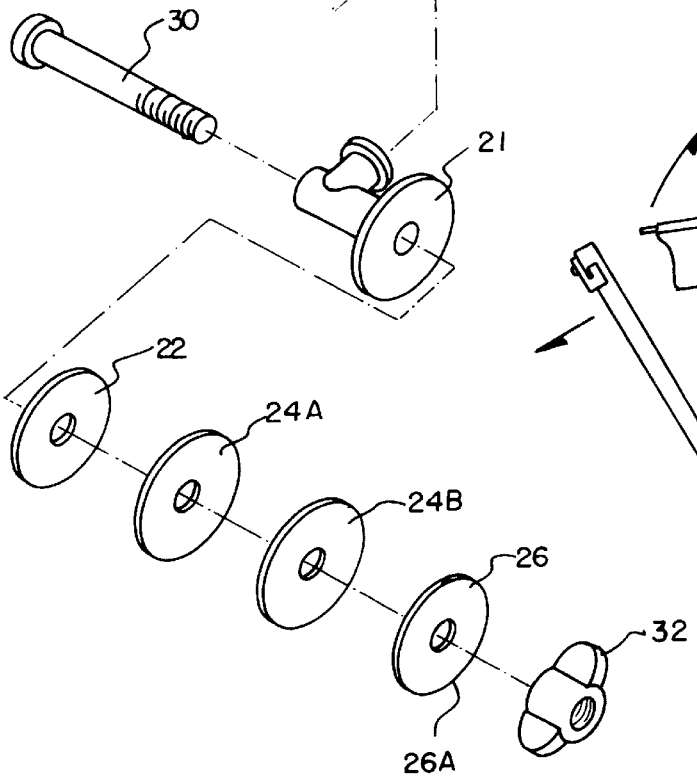
FIG. 2 is a side view of the present invention attached to a mail box having a rounded top.
Figure 2:
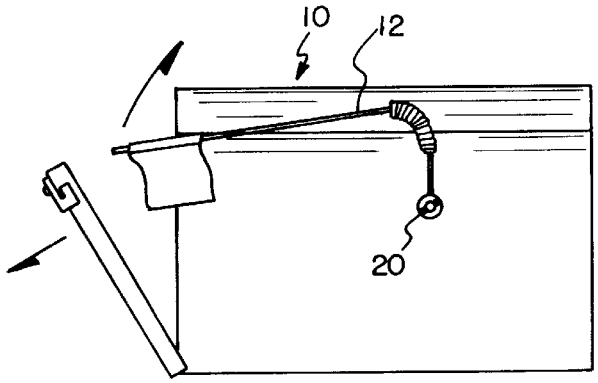
Figure 5:
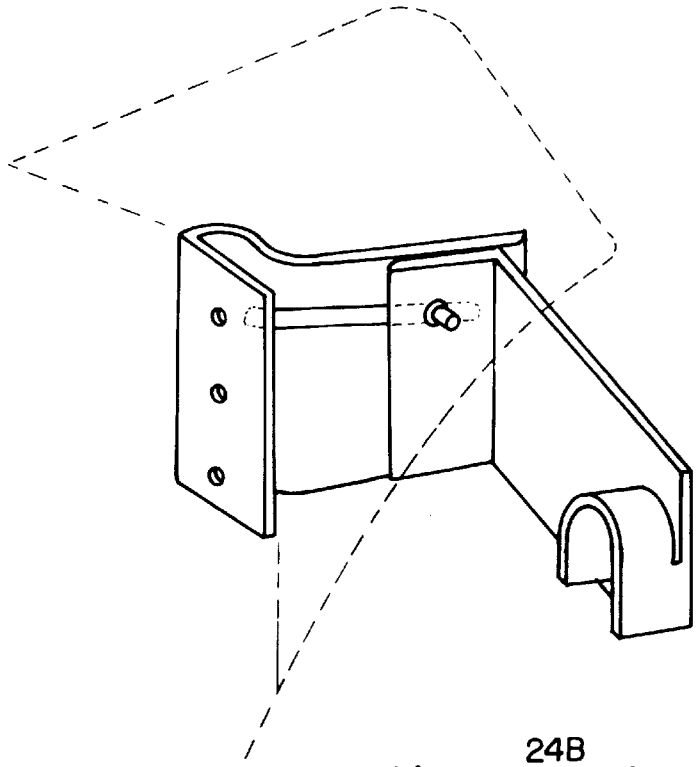
FIG. 5 is a perspective view of an alternate embodiment of the retention assembly for use with a mail box having an upper protrusion extending outwardly above the door of the mail box.
Figure 4:
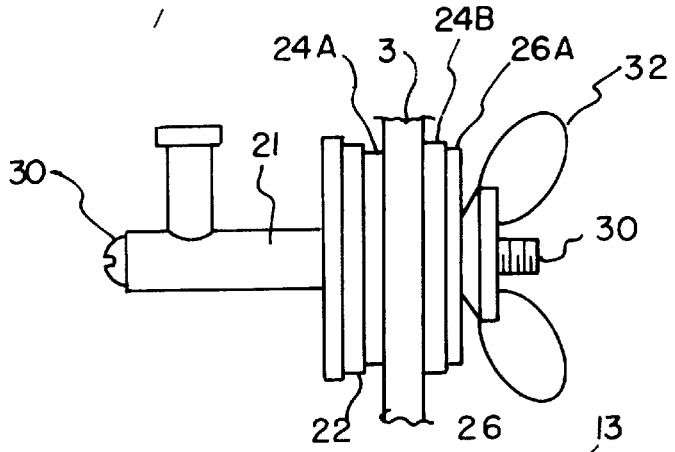
FIG. 4 is an end view of the mounting assembly of the present invention.

With reference now to the drawings, and in particular to FIGS. 1 through 5 thereof, a new mail box indicator system embodying the principles and concepts of the present invention and generally designated by the reference numeral 10 will be described.

As best illustrated in FIGS. 1 through 5, the mail box indicator system 10 comprises a post 12 having a flag 18 attached to a removable collar 14. The removable collar 14 is slidable onto the post 12. A coil 16 is positioned around an end of the post 12 opposite the collar 14; a second end of the coil 16 is coupled to an elbow member 21. Mounting means 20 designed for securing the elbow member 21 to the mail box 3 are included such that the coil 16 biases the post 12 into a substantially vertical orientation.

The mail box indicator system 10 further includes a post retention assembly 50 for holding the post 12 in a substantially horizontal orientation. The post retention assembly includes a planar portion 52 having a slot 54 for permitting attachment of the planar portion 52 to a mail box 3. A pole engagement portion 56 is disposed from the planar portion 52 for allowing insertion of a distal end of the post 12 into the post engagement portion 56 such that the post 12 is held in a substantially horizontal position when the mail box is closed. Upon opening of the door, the post engagement member 56 disengages the post 12 and the spring 16 biases the post 12 into a substantially vertical position.

The mounting means 20 is designed for securing the elbow member 21 to the mail box 3 and includes a bore 21A through the elbow member 21 and a bolt 30 passing through the bore 21A.

The bolt 30 is inserted through a first metal washer 22 so that the metal washer is positioned adjacent the elbow member 21.

The bolt 30 is then inserted through the pair of rubber washers 24 such that a first one of the pair of rubber washers 24 is positioned adjacent the first metal washer 22. The bolt 30 is inserted through a second metal washer 26. The second metal washer 26 is positioned adjacent a second one of the pair of rubber washers 24. The bolt 30 is secured by a nut 32 adjacent the second metal washer 26.

The pair of rubber washers 24 are positionable on either side of a wall of the mail box 3 whereby the elbow member 21 is secured to the mail box 3 when the nut 32 is tightened.

The mail box indicating system 10 also provides for simple replacement of the post 12 in the event that the post 12 breaks. The coil 16 tapers as it extends away from the elbow member 21. The coil 16 is selectively removable from the elbow member 21 because the post 12 is slidably insertable through the coil 16 when the coil 16 is removed from the elbow member 21 and the collar 14 is removed from the post 12. The post 12 further including a stopper 12A coupled to the post 12 to prevent the post 12 from passing entirely through the coil 16. The stopper 12A contacts the coil 16 whereby the post 12 extends a finite distance out of the coil 16.

In an alternate embodiment, an alternate post retention assembly 60 includes a planar portion 52' and a post engagement member 56' of similar structure to the first embodiment. The alternate post retention member 60 further includes a spacing member 62 having a first portion 64 for coupling to the door of a mail box and a second portion 66 extending outwardly from the first portion. The second portion includes a slot 65. The planar portion 52' of the alternate post retention assembly 60 further includes a planar extension member 68 opposite the post engagement member 56'. The planar extension member 68 includes an aperture 76 for adjustably coupling the alternate post retention assembly 60 to the spacer member 62 such that the alternate post retention assembly 60 is positionable to engage the post 12 when the mail box indicator 10 is attached to a mail box having a protrusion 4 extending outwardly around the door of the mail box.

In use the mail box indicator system 10 is attached to a wall of a mail box and the retention assembly 50 or 60 is coupled to the door of the mail box.

Figure 3:
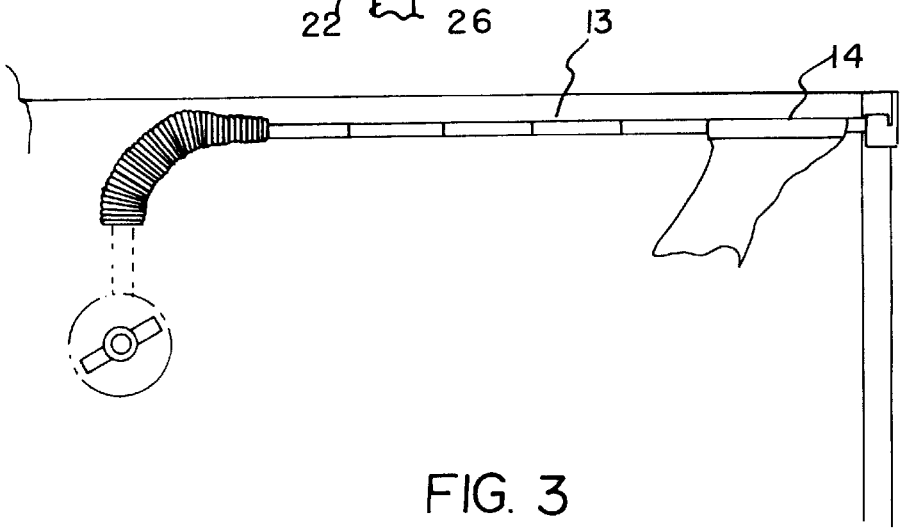
FIG. 3 is a side view of an alternate embodiment of the present invention attached to a square top mail box.

In a most preferred embodiment, the post can be constructed from a dowel rod and the stopper can be accomplished by wrapping a sufficient amount of tape around an end of the dowel rod. Thus the rod can easily and cheaply be replaced. In an alternate embodiment, a telescoping post 13, as shown in FIG. 3, can be used to provide a more compact device when not in use.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mail box indicating system for attachment to a mail box, the mail box including a wall having a hole and a door, the mail box indicating system comprising:

a post having a removable collar;

a flag being attached to said collar;

a coil, a first end of said coil being positioned around an end of said post opposite said collar, a second end of said coil being coupled to a mounting means for securing said coil to the wall of the mail box such that the coil biases the post into a substantially vertical orientation;

a post retention assembly for receiving a distal end of the post, the post retention assembly being for holding the post in a substantially horizontal position, the post retention assembly being adapted for coupling to the door of the mail box such that the retention assembly disengages the post when the door is opened whereby the coil urges the post into said vertical orientation;

a means adapted for securing an elbow member to the mailbox, wherein the means adapted for securing said elbow member to the mailbox includes:

said elbow member having a bore and a bolt passing through a lumen of said bore, said elbow member being removably coupled to said coil;

a first metal washer, said bolt being inserted through said metal washer, the metal washer being positioned adjacent the elbow member;

a pair of rubber washers, said bolt being inserted through said pair of rubber washers, a first one of said pair of rubber washers being positioned adjacent said first metal washer;

a second metal washer, said bolt being inserted through said second metal washer such that said second metal washer is positioned adjacent a second one of said pair of rubber washers;

a nut for coupling to said bolt adjacent the second metal washer;

wherein the bolt is adapted to extend through the hole in the wall of the mail box such that the pair of rubber washers are positionable on either side of the wall of the mail box whereby the elbow member is adapted to be secured to the mail box when the nut is tightened.

2. The mail box indicating system of claim 1, wherein the post retention assembly further comprises:

a substantially planar portion having a slot therein for permitting attachment of the planar portion to the mail box; and a pole engagement portion disposed from the planar portion for allowing insertion of the distal end of the post into the pole engagement portion such that the post is held in a substantially horizontal orientation.

3. The mail box indication system of claim 1 wherein the post is telescopic.

4. A mail box indicating system for attachment to a mail box, the mail box including a wall having a hole and a door, the mail box indicating system comprising:

a post having a removable collar;

a flag being attached to said collar;

a coil, a first end of said coil being positioned around an end of said post opposite said collar, a second end of said coil being coupled to a mounting means for securing said coil to the wall of the mail box such that the coil biases the post into a substantially vertical orientation;

a post retention assembly for receiving a distal end of the post, the post retention assembly being for holding the post in a substantially horizontal position, the post retention assembly being adapted for coupling to the door of the mail box such that the retention assembly disengages the post when the door is opened whereby the coil urges the post into said vertical orientation;

the coil tapering as it extends away from the mounting means, the coil further being selectively removable from the mounting means; and the post being slidably insertable through the coil when the coil is removed from the mounting means and the collar is removed from the post, the post further including a stopper coupled to the post such that the stopper is positionable within the coil such that the post is prevented from passing entirely through the coil, whereby the post extends a finite distance out of the coil.

5. A mail box indicating system for attachment to a mail box, the mail box including a wall having a hole, the mail box including a door, the mail box further having a protrusion extending outwardly around a portion of the door of the mail box when the mail box door is in a closed position, the mail box indicating system comprising:

a post having a removable collar;

a flag being attached to said collar;

a coil, a first end of said coil being positioned around an end of said post opposite said collar, a second end of said coil being coupled to a mounting means for securing said coil to the wall of the mail box such that the coil biases the post into a substantially vertical orientation;

a post retention assembly for receiving a distal end of the post, the post retention assembly being for holding the post in a substantially horizontal position, the post retention assembly being adapted for coupling to the door of the mail box such that the retention assembly disengages the post when the door is opened whereby the coil urges the post into said vertical orientation;

wherein the post retention assembly further includes:

a spacer member adapted for permitting attachment of the spacer member to the mail box, the spacer member having a slot therein;

an attachment member having a first planar portion and a pole engagement portion disposed from the first planar portion for allowing insertion of the distal end of the post into the pole engagement portion such that the post is held in a substantially horizontal orientation;

wherein the attachment member further includes a second planar portion disposed from the first planar portion, the second planar portion having an aperture therein; and the attachment member being coupled to the spacer member such that the attachment member is positionally adjustable along the slot in the spacer.

6. The mail box indicating system of claim 5, wherein the spacer member is adapted to extend outwardly from the door of the mail box at substantially a right angle; and wherein the first planar portion of the attachment member is oriented at a generally right angle to the spacer member.

7. The mail box indication system of claim 6, wherein the slot of the spacer member is adapted to extend outwardly with respect to the mail box door such that the attachment member is adapted to be selectively positionable in a generally parallel spaced relationship with the door of the mail box for positioning the post engagement portion such that the protrusion of the mail box does not interfere with engaging the post to the pole engagement portion of the attachment member.

8. The mail box indicating system of claim 5 wherein the post is telescopic.

9. A mail box indicating system for attachment to a mail box, the mail box including a wall having a hole and a door, the mail box indicating system comprising:

a post having a removable collar;

a flag being attached to said collar;

a coil, a first end of said coil being positioned around an end of said post opposite said collar, a second end of said coil being coupled to a mounting means for securing said coil to the wall of the mail box such that the coil biases the post into a substantially vertical orientation;

a post retention assembly for receiving a distal end of the post, the post retention assembly being for holding the post in a substantially horizontal position, the post retention assembly being adapted for coupling to the door of the mail box such that the retention assembly disengages the post when the door is opened whereby the coil urges the post into said vertical orientation;

a means adapted for securing an elbow member to the mail box, wherein the means adapted for securing said elbow member to the mailbox includes:

said elbow member having a bore and a bolt passing through a lumen of said bore, said elbow member being removably coupled to said coil, a first metal washer, said bolt being inserted through said metal washer, the metal washer being positioned adjacent the elbow member, a pair of rubber washers, said bolt being inserted through said pair of rubber washers, a first one of said pair of rubber washers being positioned adjacent said first metal washer, a second metal washer, said bolt being inserted through said second metal washer such that said second metal washer is positioned adjacent a second one of said pair of rubber washers, a nut for coupling to said bolt adjacent the second metal washer, and wherein the bolt is adapted to extend through the hole in the wall of the mail box such that the pair of rubber washers are positionable on either side of the wall of the mail box whereby the elbow member is adapted to be secured to the mail box when the nut is tightened;

the coil tapering as it extends away from the elbow member;

the post being slidably insertable through the coil when the coil is removed from the elbow member and the collar is removed from the post, the post further including a stopper coupled to the post such that the stopper is positionable within the coil such that the post is prevented from passing entirely through the coil, whereby the post extends a finite distance out of the coil.

10. The mail box indicating system of claim 9, wherein the post retention assembly further comprises:

a substantially planar portion having a slot therein for permitting attachment of the planar portion to the mail box; and a pole engagement portion disposed from the planar portion for allowing insertion of the distal end of the post into the pole engagement portion such that the post is held in a substantially horizontal orientation.

11. The mail box indicating system of claim 9, wherein the post is telescopic.

12. A mail box indicating system for attachment to a mail box, the mail box including a wall having a hole, the mail box including a door, the mail box further having a protrusion extending outwardly around a portion of the door of the mail box when the mail box door is in a closed position, the mail box indicating system comprising :

a post having a removable collar;

a flag being attached to said collar;

a coil, a first end of said coil being positioned around an end of said post opposite said collar, a second end of said coil being coupled to a mounting means for securing said coil to the wall of the mail box such that the coil biases the post into a substantially vertical orientation;

a post retention assembly for receiving a distal end of the post, the post retention assembly being for holding the post in a substantially horizontal position, the post retention assembly being adapted for coupling to the door of the mail box such that the retention assembly disengages the post when the door is opened whereby the coil urges the post into said vertical orientation;

wherein the post retention assembly further includes:

a spacer member adapted for permitting attachment of the spacer member to the mail box, the spacer member having a slot therein;

an attachment member having a first planar portion and a pole engagement portion disposed from the first planar portion for allowing insertion of the distal end of the post into the pole engagement portion such that the post is held in a substantially horizontal orientation;

wherein the attachment member further includes a second planar portion disposed from the first planar portion, the second planar portion having an aperture therein;

the attachment member being coupled to the spacer member such that the attachment member is positionally adjustable along the slot in the spacer;

wherein the spacer member is adapted to extend outwardly from the door of the mail box at substantially a right angle;

wherein the first planar portion of the attachment member is oriented at a generally right angle to the spacer member; and wherein the slot of the spacer member is adapted to extend outwardly with respect to the mail box door such that the attachment member is adapted to be selectively positionable in a generally parallel spaced relationship with the door of the mail box for positioning the pole engagement portion such that the protrusion of the mail box does not interfere with engaging the post to the pole engagement portion of the attachment member.

13. The mail box indicating system of claim 12, wherein the post is telescopic.

* * * * *